United States Patent [19]

Aleksandrow

[11] Patent Number: 4,530,219

[45] Date of Patent: Jul. 23, 1985

[54] SELF-REGULATED ENERGY SAVING REFRIGERATION CIRCUIT

[76] Inventor: Jerry Aleksandrow, 415 Crescent, Lombard, Ill. 60148

[21] Appl. No.: 575,005

[22] Filed: Jan. 30, 1984

[51] Int. Cl.[3] ..... F25B 43/00

[52] U.S. Cl. ..... 62/503; 62/513

[58] Field of Search ..... 62/513, 503, 512

[56] References Cited

U.S. PATENT DOCUMENTS 3,283,524 11/1966 Byron ..... 62/503 X

*Primary Examiner*—William E. Wayner

*Assistant Examiner*—John Sollecito

[57] ABSTRACT

A self-regulated refrigeration circuit incorporating a compressor/condenser guard device for cooling compressor refrigerant output prior to application to a condenser and for reevaporating liquid refrigerant discharged from the evaporators prior to its return to the compressor. A pressure differential chamber and high velocity suction line operate in conjunction with the compressor/condenser guard device to control refrigerant flow through the evaporators in both the freeze and defrost cycles of the circuit.

5 Claims, 2 Drawing Figures

SELF-REGULATED ENERGY SAVING REFRIGERATION CIRCUIT

BACKGROUND OF THE INVENTION

1. Field of the Invention

The present invention relates generally to the field of refrigeration apparatus and more particular to a new and improved refrigeration circuit which is self regulating in operation.

2. Description of the Prior Art

Prior to the present invention ice making apparatus have employed mechanical refrigeration circuits wherein a compressor discharges hot compressed refrigerant directly to a water or air cooled condenser. This arrangement results in the use of large quantities of water or air by the condensor. The compressor discharge, being at relatively high temperature and thus high pressure, produces a floodback to the compressor intake of excess refrigerant not evaporated in the system evaporator(s). This floodback produces foaming of oil in the compressor valves and bearings resulting in impaired lubrication and thence to compressor failure. Control of the prior art refrigeration circuits is effected by various arrangements of regulation valves, expansion valves or other direct refrigerant expansion devices which are subject to wear and failure.

The prior art in ice making apparatus is represented by U.S. Pat. Nos. 4,154,063, which issued on May 15, 1979, and 4,357,807, which issued on Nov. 9, 1982, both to the applicant herein.

OBJECTS AND SUMMARY OF THE INVENTION

From the preceding discussion it will be understood that among the various objectives of the present invention are included the following:

the provision of a new and improved refrigeration circuit;

the provision of apparatus of the above-described character which minimizes condenser cooling requirements;

the provision of apparatus of the above-described character which is self-regulating in operation; and the provision of apparatus of the above-described character having a minimum of moving parts.

The foregoing as well as other objectives of the present invention are efficiently achieved by providing the refrigeration circuit with a compressor/condenser guard device having two refrigerant paths therethrough. The first path is coupled between the compressor output and the condenser input and in a heat exchanging relationship with the second path which is between the evaporator output and the compressor input. The hot compressed refrigerant gas from the compressor is thereby pre-cooled before application to the condenser. Conversely the low pressure liquid and vapor refrigerant from the evaporator is further evaporated prior to application to the compressor inlet valve. The evaporator output is coupled to the second path through the compressor/condenser guard device by means of a pressure differential chamber and a high velocity suction tube which are sized with respect to the remainder of the circuit such as to provide even temperatures at the evaporators.

These and other objects, features and advantages of the present invention will become more apparent from the following detailed description taken in conjunction with the appended drawings.

DESCRIPTION OF PREFERRED EMBODIMENT

Figure 1:
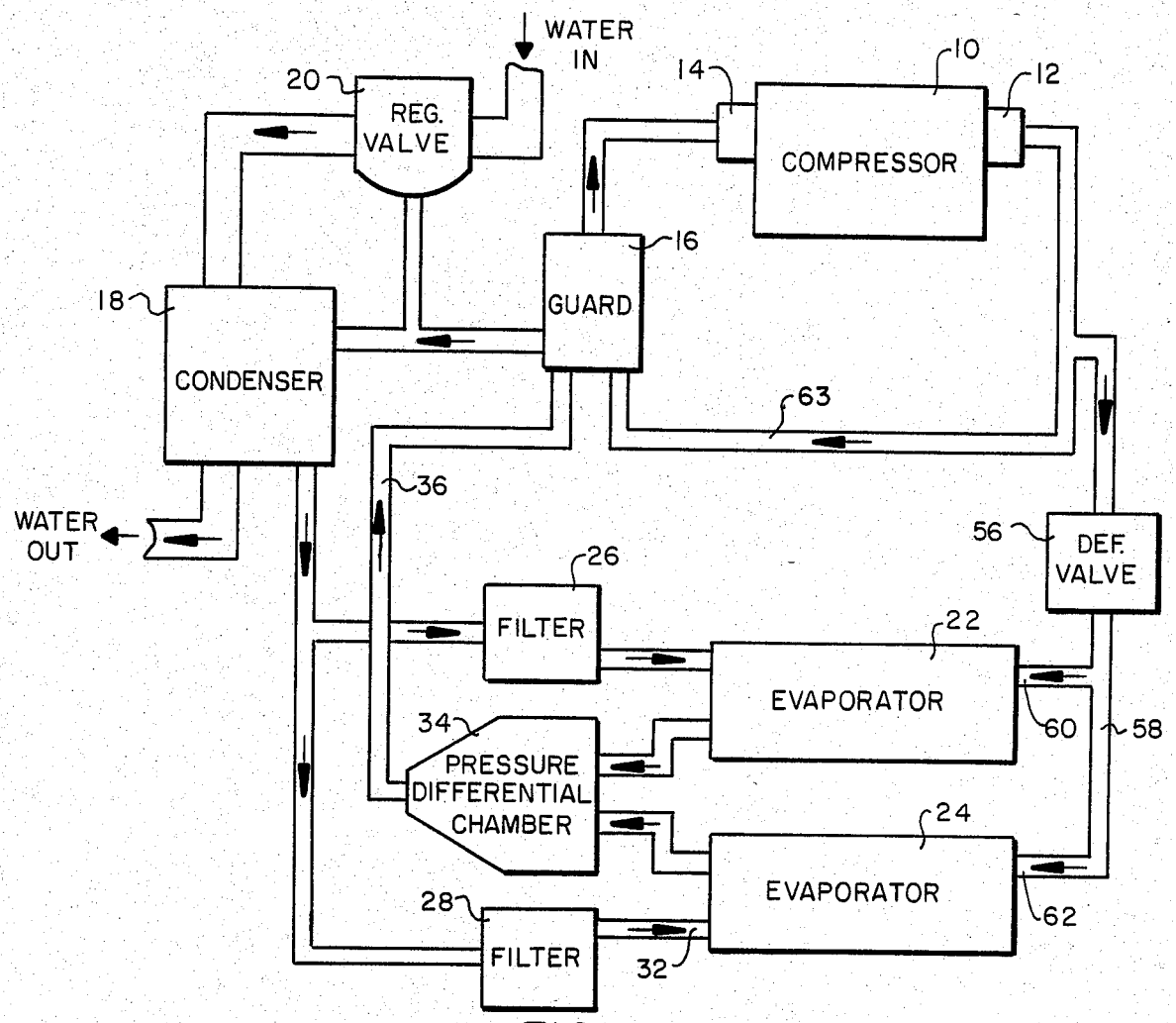
FIG. 1 is a schematic block diagram of an improved refrigeration circuit in accordance with the principle of the present invention.

With reference now to FIG. 1 there is shown a refrigeration circuit in accordance with the present invention and adapted for use in an ice making apparatus. A compressor 10 having an outlet valve 12 and inlet valve 14 operates to compress a refrigerant, such as Refrigerant No. 12, to a hot gaseous state. During the freeze cycle the hot compressor discharge is applied through a compressor/condenser guard device 16, to be described in detail hereinbelow, to the input of condenser 18. A water cooled condenser is illustrated with the water flow being controlled by a regulating valve 20 according to the pressure and thus temperature of the refrigerant at the inlet of the condenser 18.

The condenser 18 cools the refrigerant to its liquid state and delivers it to one or more evaporators 22 and 24 via filters 26 and 28 and capillary expansion tubes 30 and 32 respectively. The evaporators 22 and 24 may be of any type suitable for the particular application for which the refrigeration circuit is to be used. As applied to ice making apparatus, high static pressure evaporators known in the art are preferred.

The mechanical apparatus for applying water to the evaporators as well as for the harvesting of ice slabs and cutting them into cubes is also well known in the art and will not be discussed in detail herein. Such apparatus is described in either of the applicant's prior patents referenced hereinabove.

The refrigerant discharge from the evaporators 22 and 24 is coupled to a pressure differential chamber 34 and through a high velocity suction tube 36 to the first inlet of the compressor/condenser guard device 16 and then to the inlet valve 14 of compressor 10. The pressure differential chamber 34 is of a size related to the capacity of the compressor 10 and also depends upon the number of evaporators used in the circuit. The pressure differential chamber 34 operates to balance the pressure in the evaporators 22 and 24 and acts as a high velocity orifice. The pressure differential across the chamber 34 is such that the outlet velocity of the refrigerant exceeds the inlet velocity by a factor in excess of the number of evaporators used in the circuit, e.g. with two evaporators the outlet velocity exceeds twice the inlet velocity. The high velocity suction tube 36, although being of a diameter of only about 50% of that of the outlet of any given evaporator, due to the high flow velocity removes refrigerant at a rate which exceeds the total evaporator discharge by approximately 25%. The pressure differential chamber 34 therefore has an internal volume sufficient that 125% of the maximum total evaporator output may flow therethrough without restriction. The presence of the pressure differential chamber 34 prevents any back up of refrigerant from the compressor/condenser guard device 16. The high velocity suction tube 36 is also sized to match the particular capacity of the compressor 10 and the volume of refrigerant vapor evaporated into gas by the compressor/condenser guard device 16 which is in turn matched to the capacity of the particular compressor 10 used in the circuit. The combination of the pressure differential chamber 34 and high velocity suction tube 36 create a relatively lower pressure at the outlet than at the inlet of the evaporators 22 and 24. This condition causes the vaporized refrigerant to move more rapidly through the evaporators 22 and 24 and to tend to remain in vapor form rather than liquid; the vapor form being a more efficient heat absorber. The evaporators 22 and 24 therefore operate during the freeze cycle at a lower and more evenly distributed temperature.

Figure 2:
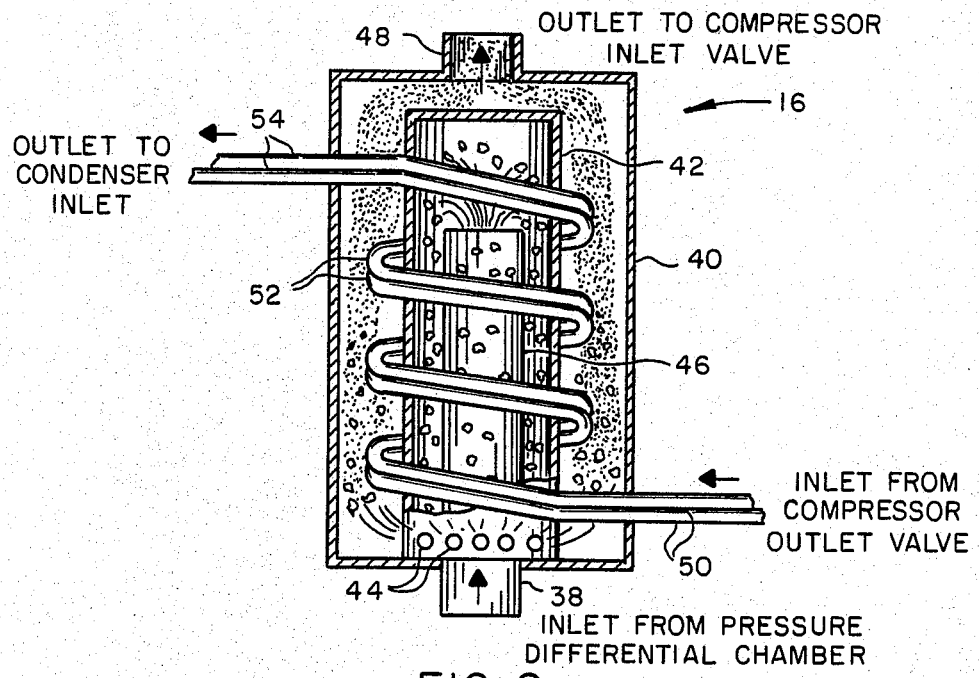
FIG. 2 is a longitudinal cross-section view of the compressor/condenser guard device of FIG. 1.

FIG. 2 illustrates in longitudinal cross section the compressor/condenser guard device 16 of FIG. 1 which, together with the pressure differential chamber 34 and high velocity suction tube 36 of FIG. 1, forms the essence of the applicant's invention. The guard device provides two separate refrigerant paths therethrough which are in a heat exchanging relationship with one another. The first inlet 38 is coupled to the pressure differential chamber via the high velocity suction tube and receives the high velocity low pressure cold refrigerant which is discharged from the evaporators in a partially liquid but largely vapor state. Within an outer housing 40 there is disposed a cylindrical turbulence chamber 42 closed at one end and having a plurality of outlet orifices 44 about its circumferance at the opposite end adjacent the first inlet 38. The first inlet 38 communicates with a central tube 46 through which the cold refrigerant is discharged at high velocity into the turbulence chamber 42. The turbulence within chamber 42 tends to break up any liquid refrigerant into small particles which pass through the orifices 44 into the outer housing 40. The outer housing 40 in turn has a first outlet 48 which is coupled to the inlet valve 14 of the compressor 10 as shown in FIG. 1.

The second inlet 50 receives the high pressure hot refrigerant from the compressor outlet which is then applied to a heat exchange coil 52 which is disposed about the turbulence chamber 42 within the outer housing 40. The second outlet 54 couples the coil 52 to the inlet of condenser 18 as shown in FIG. 1. The coil 52 is preferably a plurality of thin tubes such that the heat exchanging surface may be maximized. In operation the heat from the hot refrigerant in coil 52 is used to re-evaporate any liquid refrigerant being returned from the evaporators prior to its being forwarded to the compressor. Conversely, the hot refrigerant in the coil 52 is cooled before being applied to the condenser via second outlet 54.

The compressor/condenser guard device 16 in the refrigeration circuit provides a number of advantages over the prior art. By re-evaporating any liquid refrigerant prior to its return to the compressor the detrimental effects of interaction between liquid refrigerant and oil in the compressor valves and bearings is avoided thus enhancing the compressor lifetime. While being re-evaporated, the refrigerant being returned to the compressor remains relatively cool which tends to prevent breakdown of the compressor oil and formation of acid which is harmful to the mechanical components of the compressor. By pre-cooling the compressed refrigerant before application to the condenser it is possible to use a smaller capacity and thus less expensive and more energy efficient condenser in the circuit. Furthermore, since the condenser is required to remove substantially less heat from the refrigerant there is a significant savings in the amount of water necessary for condenser operation. Similar benefits are provided where an air cooled condenser is used. In practice the applicant has found that the temperature of the compressed refrigerant is reduced in the compressor/condenser guard device by about 35–40° F.

Due to the structural arrangement of the compressor/condenser guard device 16 there is a lower static pressure at the outlet 48 than at the inlet 38 such that the re-evaporated refrigerant, which is of a slightly elevated pressure, is prevented from backing up into the evaporators. In practical effect the compressor/condenser guard device 16, high velocity suction tube 36 and pressure differential chamber 34 function in this respect as a passive check valve to prevent refrigerant flood-back to the evaporator outlets. The circuit is therefore self-regulating since an even and steady compressor 10 suction is maintained regardless of varying compressor head discharge pressures caused by ambient temperature changes. Through use of the compressor/-condenser guard device 16 it becomes possible to use any type of expansion device, such as a simple capillary tube, at the evaporator inlets and it is unnecessary to closely meter and regulate the refrigerant pressure. The refrigerant supply lines may be oversized to flood the evaporators to achieve what is known in the art as a low superheat of 0.0° F. which assures the complete saturation of the entire surface of the evaporators thereby maximizing their capacity. The combination of the compressor/condenser guard device 16, pressure differential chamber 34 and high velocity suction tube 36 provides a sufficient supply of cold refrigerant to quickly cool the compressor output as described above.

Returning now to FIG. 1, when a predetermined amount of ice has been formed on the evaporators 22 and 24, whether determined by a timer or other means, it is necessary to briefly warm the evaporator surfaces to free the ice for harvesting. A defrost solenoid valve 56 is opened in refrigerant line 58. Due to the high static pressure at the compressor outlet 12 the hot refrigerant passes through line 58 and is applied to the defrost inlets 60 and 62 of evaporators 22 and 24 respectively. Again the pressure differential chamber 34 and high velocity suction line 36, being of a configuration related to the compressor 10 capacity, control the flow of the hot refrigerant to only that minimally necessary to free the ice from the evaporators. Overheating of the evaporators is prevented such that when the defrost solenoid valve 56 is closed a minimum amount of heat is required to be removed from the evaporators before the next freeze cycle may begin.

As indicated above the pressure differential chamber 34 and the high velocity suction tube 36 are of sizes which are selected to match the particular capacity of the compressor 10 used in the refrigeration circuit. By way of illustrative example, a circuit using a Copeland model KAT20150CAB one and one-half horsepower compressor which is commercially available from Copeland Corporation of Sidney, Ohio, and two evaporators, a pressure differential chamber having an internal volume of 0.5 cubic inch and a high velocity suction line having an inside diameter of 5/16 inch efficiently operate with the compressor/condenser guard device.

From the preceding discussion it will be seen that the applicant has provided a new and novel refrigeration circuit whereby the objectives set forth hereinabove are efficiently achieved. Since certain changes in the abovedescribed construction will occur to those skilled in the art without departure from the scope of the invention it is intended that all matter set forth in the foregoing description or shown in the appended drawings shall be interpreted as illustrative and not in a limiting sense.

Having described what is new and novel and desired to secure by Letters Patent, what is claimed is:

1. An improved refrigeration circuit of the type having a compressor with an output coupled to the inlet of a condenser which in turn has an outlet coupled to the inlet of at least one evaporator, the outlet of which is coupled to the inlet of said compressor and wherein said improvement comprises a compressor/condenser guard device having an outer housing, a turbulence chamber disposed within said outer housing, said turbulence chamber being closed at the upper end thereof and having a plurality of outlet orifices in communication with said outer housing at the lower end thereof, a first inlet coupled to said evaporator outlet and in communication with and extending into said turbulence chamber, a first outlet coupled to said compressor inlet and in communication with said outer housing to form a first refrigerant path, a heat exchanging coil within said outer housing having an inlet coupled to said compressor outlet and an outlet coupled to said condenser inlet to form a second refrigerant path in a heat exchanging relationship with said first refrigerant path.

whereby compressed refrigerant from said compressor is pre-cooled before being applied to said condenser inlet and any liquid refrigerant from said evaporator is re-vaporized before being applied to said compressor inlet.

2. A refrigeration circuit as set forth in claim 1 wherein said heat exchanging coil comprises a plurality of tubes communicating between said second inlet and said second outlet.

3. A refrigeration circuit as set forth in claim 1 further including a pressure differential chamber coupled between said evaporator outlet and said first refrigerant path through said compressor/condenser guard device, said pressure differential chamber operating as a high velocity orifice sized relative to the capacity of said compressor such as to increase the rate of flow of refrigerant through said evaporator.

4. A refrigeration circuit as set forth in claim 3 wherein said pressure differential chamber has an internal volume selected with respect to said compressor capacity to produce a pressure differential between the inlet and outlet thereof such that the refrigerant velocity at the outlet thereof is greater than the refrigerant velocity at the inlets thereto multiplied by the number of said inlets.

5. A refrigeration circuit as set forth in claim 1 further including each said evaporator having a defrost inlet; and a selectably operable defrost valve coupled between the outlet of said compressor and the defrost inlet of each said evaporator;

whereby hot compressed refrigerant is intermittently applied to each said evaporator to periodically defrost the same.

* * * * *